United States Patent [19]

Ohba et al.

[11] Patent Number: 4,594,589

[45] Date of Patent: Jun. 10, 1986

[54] METHOD AND CIRCUIT FOR DRIVING ELECTROLUMINESCENT DISPLAY PANELS WITH A STEPWISE DRIVING VOLTAGE

[75] Inventors: Toshihiro Ohba, Nara; Hiroshi Kinoshita, Tenri; Yoshiharu Kanatani, Nara; Hisashi Uede, Yamatokoriyama, all of Japan

[73] Assignee: Sharp Kabushiki Kaisha, Osaka, Japan

[21] Appl. No.: 412,377

[22] Filed: Aug. 27, 1982

[30] Foreign Application Priority Data

| | | | |
|---|---|---|---|
| Aug. 31, 1981 | [JP] | Japan | 56-137929 |
| Aug. 31, 1981 | [JP] | Japan | 56-137930 |
| Sep. 30, 1981 | [JP] | Japan | 56-157145 |
| Sep. 30, 1981 | [JP] | Japan | 56-157148 |

[51] Int. Cl.[4] ..... G09G 3/12

[52] U.S. Cl. ..... 340/805; 340/781

[58] Field of Search ..... 340/781, 805, 718, 719, 340/713, 812

[56] References Cited

U.S. PATENT DOCUMENTS

| | | | |
|---|---|---|---|
| 3,975,661 | 8/1976 | Kanatani et al. | 340/805 |
| 4,137,523 | 1/1979 | Mukaiyama | 340/805 |
| 4,152,626 | 5/1979 | Hatta et al. | 340/805 |
| 4,234,821 | 11/1980 | Kako et al. | 340/781 |
| 4,237,456 | 12/1980 | Kanatani | 340/781 |
| 4,338,598 | 7/1982 | Ohba et al. | 340/781 |
| 4,479,120 | 10/1984 | Ohba et al. | 340/781 |

*Primary Examiner*—Marshall M. Curtis

*Attorney, Agent, or Firm*—Birch, Stewart, Kolasch & Birch

[57] ABSTRACT

A method for driving a thin-film electroluminescent (EL) display panel comprises the steps of charging the EL display panel by applying to the EL display panel a voltage of $KV_0$ where $V_0$ is a voltage for emitting electroluminescence from the EL display panel and K is more than zero and less than 1, and applying the voltage of $V_0$ to the EL display panel, whereby the EL display panel is driven with a stepwise driving pulse due to the capacitance feature of the EL display panel. A circuit for enabling the method is also provided.

17 Claims, 15 Drawing Figures

METHOD AND CIRCUIT FOR DRIVING ELECTROLUMINESCENT DISPLAY PANELS WITH A STEPWISE DRIVING VOLTAGE

BACKGROUND OF THE INVENTION

The present invention relates to methods and circuits for driving display panels and, more particularly, to methods and circuits for driving thin-film electroluminescent (referred to as "EL" hereinafter) display panels.

Thin-film EL display panels can be adapted to planar display devices suitable for output terminals of computers. Thin-film EL display panels are provided for indicating characters, symbols, still pictures, or motion pictures.

Thin-film EL display panels are superior to conventional cathode ray tubes (CRT) because of a low operation voltage thereof, to plasma display panels (PDP) because of small weight and strong intensity thereof, and to liquid crystal displays (LCD) because of a wider operational environment. A long life time can be expected in the thin-film EL displays owing to a complete solid display device. An input/output display terminal for the computer is facilitated by the thin-film EL display because it has accurate address capability.

Therefore, it is desired to drive the thin-film EL display panels with as low power consumption as possible.

SUMMARY OF THE INVENTION

Accordingly, it is an object of the present invention to provide improved methods and circuits for driving thin-film EL display panels with low power consumption.

It is another object of the present invention to provide improved methods and circuits for driving thin-film EL display panels by superimposing the voltage of a power source with the voltage on a capacitor which is charged by the power source.

Briefly described, in accordance with the present invention, a method for driving a thin-film electroluminescent (EL) display panel comprises the steps of charging the EL display panel by applying to the EL display panel a voltage of $KV_0$ where $V_0$ is a voltage for emitting electroluminescence from the EL display panel and K is more than zero and less than 1, and applying the voltage of $V_0$ to the EL display panel, whereby the EL display panel is driven with a stepwise driving pulse due to the capacitance feature of the EL display panel. A circuit for enabling the method is also provided.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
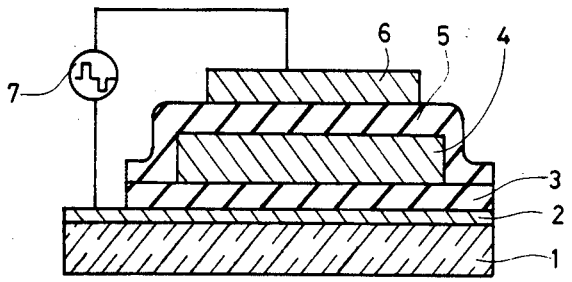
FIG. 1 shows a cross-sectional view of a conventional thin-film EL display panel.

Referring now to FIG. 1, the conventional thin-film EL display panel comprises a glass substrate 1, a transparent electrode 2 made of $In_2O_3$, and $SnO_2$ etc., formed thereon, a first dielectric layer 3 made of $Y_2O_3$, $TiO_2$, $Al_2O_3$, $Si_3N_4$, and $SiO_2$ etc., a thin-film EL layer 4 of ZnS:Mn, a second dielectric layer 5, and a counter electrode 6 made of Al.

The first dielectric layer 3 is formed by sputtering techniques or electron beam evaporation. The thin-film EL layer 4 is provided through the use of the electron beam evaporation of a source material, a ZnS pellet doped with Mn of a desirable quantity. An AC power source 7 is coupled to the transparent electrode 2 and the counter electrode 6 to drive the thin-film EL display panel.

With the application of the AC power source 7, the thin-film EL panel is activated so that a plurality of electrons are energized to form a conduction band. The electrons of the luminescent center of Mn are excited and, thereafter, when the excited luminescent center is brought back to an unexcited condition, yellow emission is developed as electroluminescent light. That is, the electrons energized by the high potential energy activates the Mn electron positioned on a Zn site of the luminescent center of the thin-film EL layer 4. When an Mn electron is brought back to the unexcited condition, a yellow emission having a peak frequency is about 5,850 Å and a relatively wide frequency range is developed. As the active elements, Mn can be replaced by a rare earth elements such as F, etc., a green emission or the like peculiar to one of the rare earth elements may be developed.

The above-described thin-film EL display panels can be assumed to be capacitive elements similar to capacitors. The driving voltage to be applied to the thin-film EL dislay panel is very high, say, about 200 V and the capacitance of the thin-film EL display panel is very large, say, about 6 nF/cm$^2$. In calculating a power consumed for driving to emit the electroluminescence, a power to be consumed for emission can be neglected as the charging/discharging power to the panel capacitance is assumed to be the substantial amount of power consumption.

Figure 2:
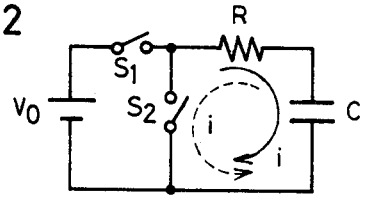
FIG. 2 shows a schematic representation of a charging/discharging operation of a conventional driving circuit.

Therefore, the thin-film EL display panel is assumed to be a condenser C to calculate the power necessary for charging/discharging a voltage $V_0$ once as follows:

FIG. 2 shows a diagram of a conventional driving circuit in which a charging/discharging operation is carried out. When a switch $S_2$ is off and a switch $S_1$ is on in the circuit of FIG. 2, a condenser C is charged through a resistor R by a power source $V_0$ according to the following equation.

$$R_i + \frac{1}{C}\int idt = V_0 \quad (1)$$

In terms of a charge q, $$R\frac{dq}{dt} + \frac{1}{C}q = V_0 \quad (2)$$

The general solution of this equation is as follows, as is well known (under the condition that q=0 when t=0).

$$q = CV_0\left(1 - e^{-\frac{1}{CR}t}\right) \quad (3)$$

$$i = \frac{dq}{dt} = \frac{V_0}{R}e^{-\frac{t}{CR}} \quad (4)$$

Electric powers $W_R$ and $W_C$ of the resistor R and the condenser C are calculated in the following equations.

$$W_R = \int_0^t i^2Rdt = \tfrac{1}{2}CV_0^2\left(1 - e^{-\frac{2}{CR}t}\right) \quad (5)$$

$$W_C = \int_0^t Vidt = \tfrac{1}{2}CV_0^2\left(1 - e^{-\frac{2}{CR}t}\right)^2 \quad (6)$$

When $t \rightarrow \infty$, equations (5) and (6) provide the following value.

$$W_R = W_C = \tfrac{1}{2}CVO^2 \quad (7)$$

Equation (7) indicates that half of the energy supplied by the power source is consumed by the resistor R and half of the energy is condensed by the condenser C. The energy stored in the condenser C is discharged, when the switch $S_1$ is off and the switch $S_2$ is on, and is consumed by the resistor R. Thus, in the conventional method, a total electric energy required to charge and discharge from the condenser C the voltage $V_0$ is $CV_0$.

Figure 3:
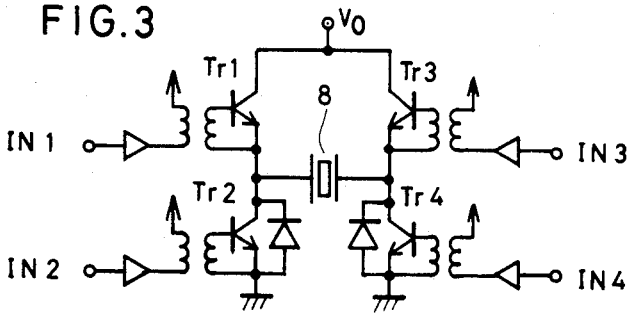
FIG. 3 shows a diagram of a conventional driving circuit.
Figure 4:
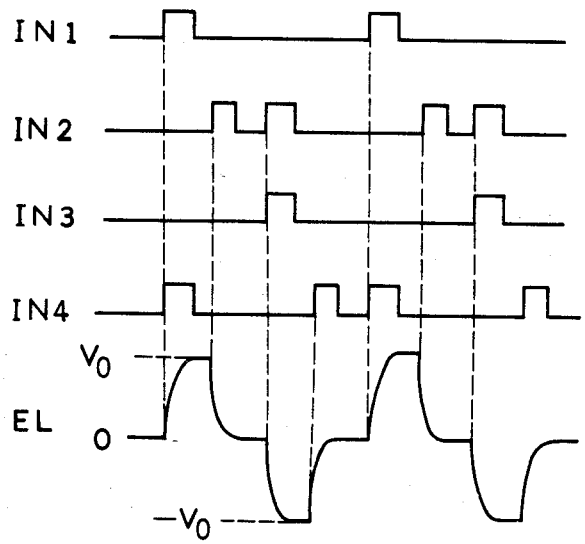
FIG. 4 shows a timing chart of signals inputted to the circuit of FIG. 3.

FIG. 3 shows a conventional driving circuit. FIG. 4 shows a timing chart of voltage signals inputted to terminals of the circuit of FIG. 3 and to a thin-film EL display element 8.

Pulses are applied to terminals $IN_1$, $IN_2$, $IN_3$ and $IN_4$, to which a source voltage $V_0$ is supplied, at the timing of FIG. 4 to switch the base voltage of transistors. An alternating pulse field is applied to the thin-film EL display element 8 to drive the element 8 in a seesaw driving method to provide the electroluminescence.

More particularly, when pulses are applied to the terminals $IN_1$ and $IN_4$, the transistors $Tr_1$ and $Tr_4$ are conductive. A current flows through the element 8 from the transistor $Tr_1$ to the transistor $Tr_4$ to charge the element 8. At the next period, the pulse is inputted only to the terminal $IN_2$ to conduct the transistor $TR_2$, so that the charge in the element 8 is discharged.

When the pulses are inputted to the terminals $IN_2$ and $IN_3$, the transistors $Tr_2$ and $Tr_3$ are conductive. A current flows through the element 8 from the transistor $Tr_3$ to the transistor $Tr_2$ to charge the element 8 in a polarity opposed to the above case. At the next period, when the pulse is inputted only to the terminal $IN_4$, the transistor $Tr_4$ is conductive, so that the charge in the element 8 is discharged.

Thus, the thin-film EL display element 8 is driven according to the alternating operation with the application of the pulses to provide the electroluminescence.

To reduce the power consumption for driving the thin-film EL display panel, the present invention is considered.

Figure 5:
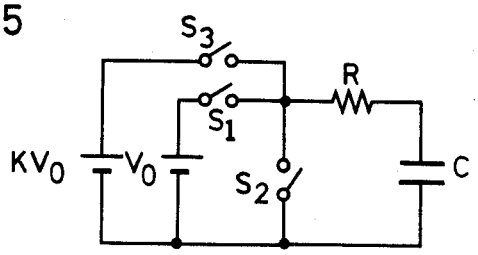
FIG. 5 shows a diagram of a driving circuit according to the present invention.

FIG. 5 shows a driving circuit according to the present invention. When switches $S_1$ and $S_2$ are off and switch $S_3$ is on, a condenser C (the thin-film EL display element) is charged through a resistor R by a power source $KV_0$ ($O<K<1$). The value of $V_0$ is to provide the electroluminescence. Next, the switches $S_2$ and $S_3$ are off and the switch $S_1$ is on to charge the condenser C by a power source $V_0$. This charging method is hereinafter called a step driving method hereinafter. For discharging, only the switch $S_2$ is on as is similar to conventional case.

An electric power required for the charge/discharge operation in the step driving method is calculated as follows:

Owing to the charge by the power source $KV_0$, the electric power supplied the resistor R and the condenser C are obtained according to equation (7).

$$W_R' = W_C' = \tfrac{1}{2}C(KV_0)^2 \quad (8)$$

An electric power necessary for charging the condenser C by the power source $V_0$ is obtained under the condition of equation (2) and, $q_0 = CKV_0$ when t=0.

$$W_R' = \frac{V_0^{2(1-k)2}}{R}\int_0^t e^{-\frac{2}{CR}t}dt \quad (9)$$

$$W_C' = \frac{V_0^{2(1-K)}}{R}\int_0^t e^{-\frac{t}{CR}}\left[1 - (1-k)e^{-\frac{t}{CR}}\right]dt \quad (10)$$

When $t \rightarrow \infty$, equations (9) and (10) are assumed as follows.

$$W_R'' = \tfrac{1}{2}C(1-K)^2V_0^2 \quad (11)$$

$$W_C'' = C(1-K)V_0^2 - \tfrac{1}{2}C(1-K)^2V_0^2 \quad (12)$$

Then, in the charging period of the step driving method, electric powers $W_{RS}$ and $W_{CS}$ of the resistor R and the condenser C are obtained according to equations (8), (11), and (12).

$$W_{RS} = \tfrac{1}{2}CK^2V_0^2 + \tfrac{1}{2}C(1-K)^2V_0^2 \quad (13)$$

$$W_{CS} = \tfrac{1}{2}CV_0^2 \quad (14)$$

The energy stored in the condenser C as represented by equation (14) is consumed by the resistor R when discharging. A power $W_S$ required to charge in and discharge the condenser C with a voltage of $V_0$ is represented as follows according to equations (13) and (14).

$$W_S = W_{RS} + W_{CS} = [(K - \tfrac{1}{2})^2 + \tfrac{3}{4}]CV_0^2 \quad (15)$$

Figure 6:
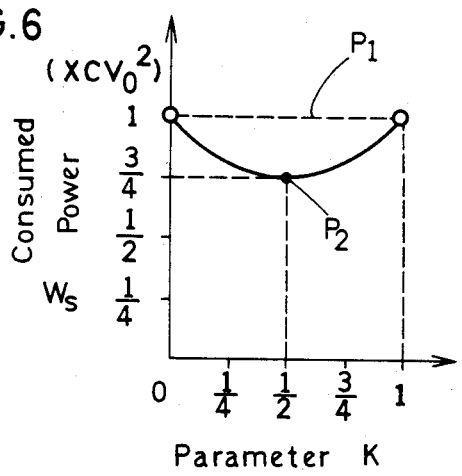
FIG. 6 shows a graph representing the comparison between the conventional driving method and the driving method according to the present invention in terms of the amount of power consumption.

FIG. 6 shows the relation between the power $W_S$ of equation (15) and the parameter K. In FIG. 6, a dotted line $P_1$ is related to the conventional driving method and a curve $P_2$ is related to the step driving method of the present invention. The graph of FIG. 6 indicates that the power $W_S$ is minimized at $K=\frac{1}{2}$ in which the power consumption is about three-fourths as compared with the conventional case. The results when the thin-film EL display panel is driven according to the step driving method agree with the above principle.

Figure 7:
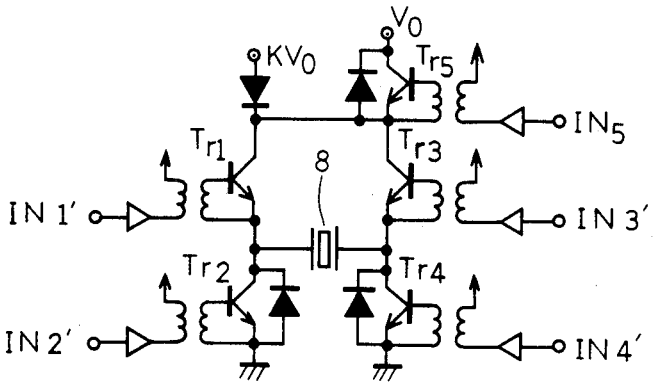
FIG. 7 shows a diagram of a driving circuit for enabling a stepping operation according to the principle used in the present invention.
Figure 8:
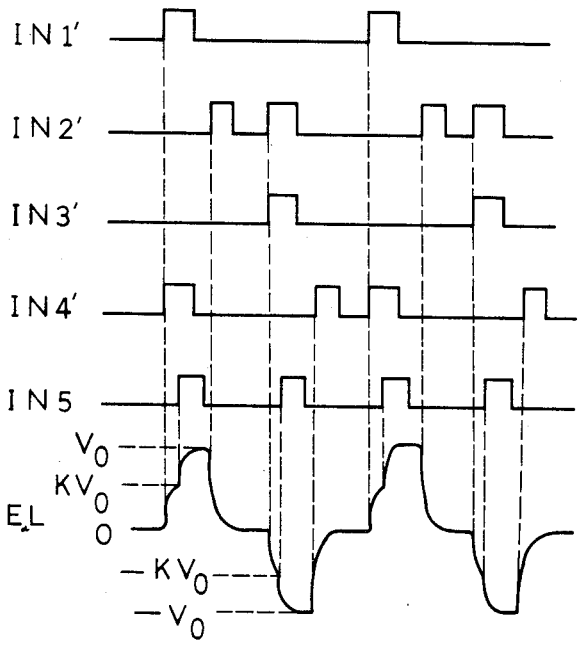
FIG. 8 shows a timing chart of signals inputted to the circuit of FIG. 7.

FIG. 7 shows a configuration of a driving circuit according to the present invention to enable the step driving method. The circuit of FIG. 7 is detailed more than that of FIG. 3. FIG. 8 shows a timing chart of pulses inputted to the terminals of FIG. 7 and the thin-film EL element 8.

The pulses are applied to the terminals $IN_1'$, $IN_2'$, $IN_3'$ and $IN_4'$ as is similar to the case of FIG. 4. The step driving method is enabled by the pulse inputted to the terminal $IN_5$. The rising of the driving pulse applied to the element 8 is synchronized with the rising of the pulse applied to the terminal $IN_5$. The driving pulse applied to the element 8 is raised in two steps. The charge stored in the element 8 is discharged by selectively applying the pulses to the terminals $IN_2'$ and $IN_4'$ as is similar to the conventional case.

The thin-film EL display element 8 is driven according to the alternating current when either pair of the transistors $Tr_1$ and $Tr_4$, or $Tr_2$ and $Tr_3$ are alternatively conductive. While the positive/negative pulse applied to the element 8 being developed, the transistor $Tr_5$ is driven conductive to superimpose the seesaw driving method and the step driving method.

As a disadvantage in the step driving method, two power sources $KV_0$ and $V_0$ are required to reduce its practicability. In the circuit of FIG. 2 in which a unitary power source $V_0$ is provided, the switch $S_2$ is off and the switch $S_1$ is on.

When the voltage across the ends of the condenser C becomes $KV_0$, the switch $S_1$ is off. The switch $S_1$ is on to charge the condenser C up to a voltage of $V_0$, so that signals applied to the condenser C are stepwise.

However, the sum of electric powers of the resistor R and the condenser C in the charging period proves to be the value as represented by equation (7) for the following reason. For convenience, a case of $K=\frac{1}{2}$ is exemplified. Electric powers $W_R$ and $W_c$ of the resistor R and the condenser C at the time when the voltage across the ends of the condenser C is $\frac{1}{2}V_0$ are obtained.

From equation (3), $$q = C(\tfrac{1}{2}V_0) = CV_0\left(1 - e^{-\frac{1}{CR}t}\right) \quad (3)'$$

When equation (16) is substituted in equations (5) and (6), $$W_R = \tfrac{3}{8}CV_0^2 \quad (17)$$

$$W_c = \tfrac{1}{8}CV_0^2 \quad (18)$$

Electric powers $W_R'$ and $W_C'$ from $V_0/2$ to $V_0$ are calculated by substituting $\frac{1}{2}$ for K in equations (11) and (12).

$$W_R' = \tfrac{1}{8}CV_0^2 \quad (19)$$

$$W_C' = \tfrac{3}{8}CV_0^2 \quad (20)$$

The sum of the values of equations (17), (18), (19) and (20) is $CV_0^2$, indicating that the consumed power is not reduced in the conventional driving method as indicated in FIG. 2. According to the present invention, the consumed power is reduced.

Figure 9:
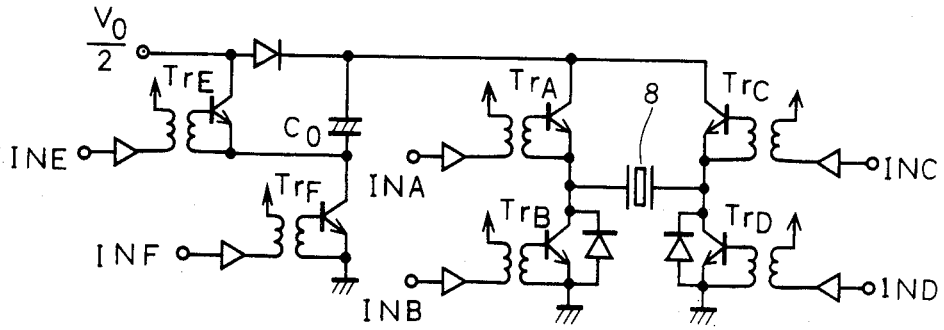
FIG. 9 shows a diagram of a driving circuit according to the present invention.
Figure 10:
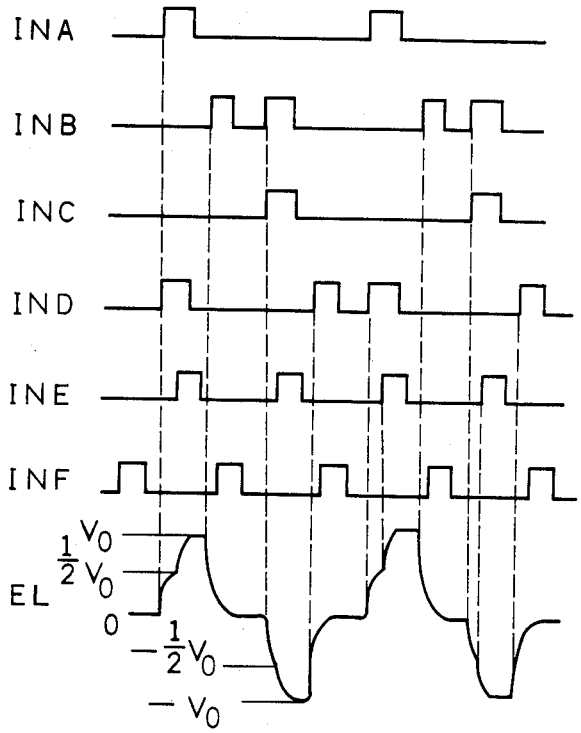
FIG. 10 shows a timing chart of signals inputted to the circuit of FIG. 9.

FIG. 9 shows a driving circuit of the present invention. FIG. 10 shows a timing chart of signals inputted to the circuit of FIG. 9.

An external power source having a voltage of $\frac{1}{2}V_0$ ($K=\frac{1}{2}$ in case of $KV_0$) is employed. Pulses are applied to terminals INA and IND to make transistors $T_{rA}$ and $T_{rD}$ conductive, the bases of the transistors $T_{rA}$ and $T_{rD}$ being coupled to the temrinals INA and IND, respectively. Then, the voltage of $\frac{1}{2}V_0$ is applied to the thin-film EL display element 8. A pulse is applied to a terminal INE to make a transistor $T_{rE}$ conductive. A voltage doubler circuit for a power source is provided using a coupling condenser $C_0$. A voltage of $V_0$ is applied to the thin-film EL display element 8. Voltages of $\frac{1}{2}V_0$ and $V_0$ in two steps are subsequently applied to the element 8 to provide the electroluminescence.

A pulse is inputted to a terminal INB to make a transistor $T_{rB}$ conductive, so that charges in the element 8 is discharged. A pulse is inputted to a terminal INF to make a transistor $T_{rF}$ conductive, the transistor $T_{rF}$ leading the condenser Co to the ground. Pulses are inputted to terminals INB and INC to make transistor $T_{rB}$ and $T_{rC}$ conductive. A voltage of $\frac{1}{2}V_0$ is applied to the element 8 and has a polarity opposed to the above case. A pulse is applied to a terminal INE to make a transistor $T_{rE}$ conductive. A doubled voltage of $V_0$ is applied to the element 8 by superimposing charges in the condenser $C_0$ on a voltage of the power source $V_0/2$. Therefore, the element 8 emits the electroluminescence in response to the application of a pulse having a reverse polarity.

A pulse is applied to a terminal IND to make a transistor $T_{rD}$ conductive, so that the element 8 is discharged. A pulse is applied to a terminal INF to make a transistor $T_{rF}$ conductive, so that the condenser $C_0$ is grounded. By repeating the above operations the thin-film EL display element 8 is driven with a unitary power source by superimposing the seesaw driving method and the step driving method.

In another form of the present invention, a driving circuit comprises a high voltage N-channel MOS IC.

Figure 11:
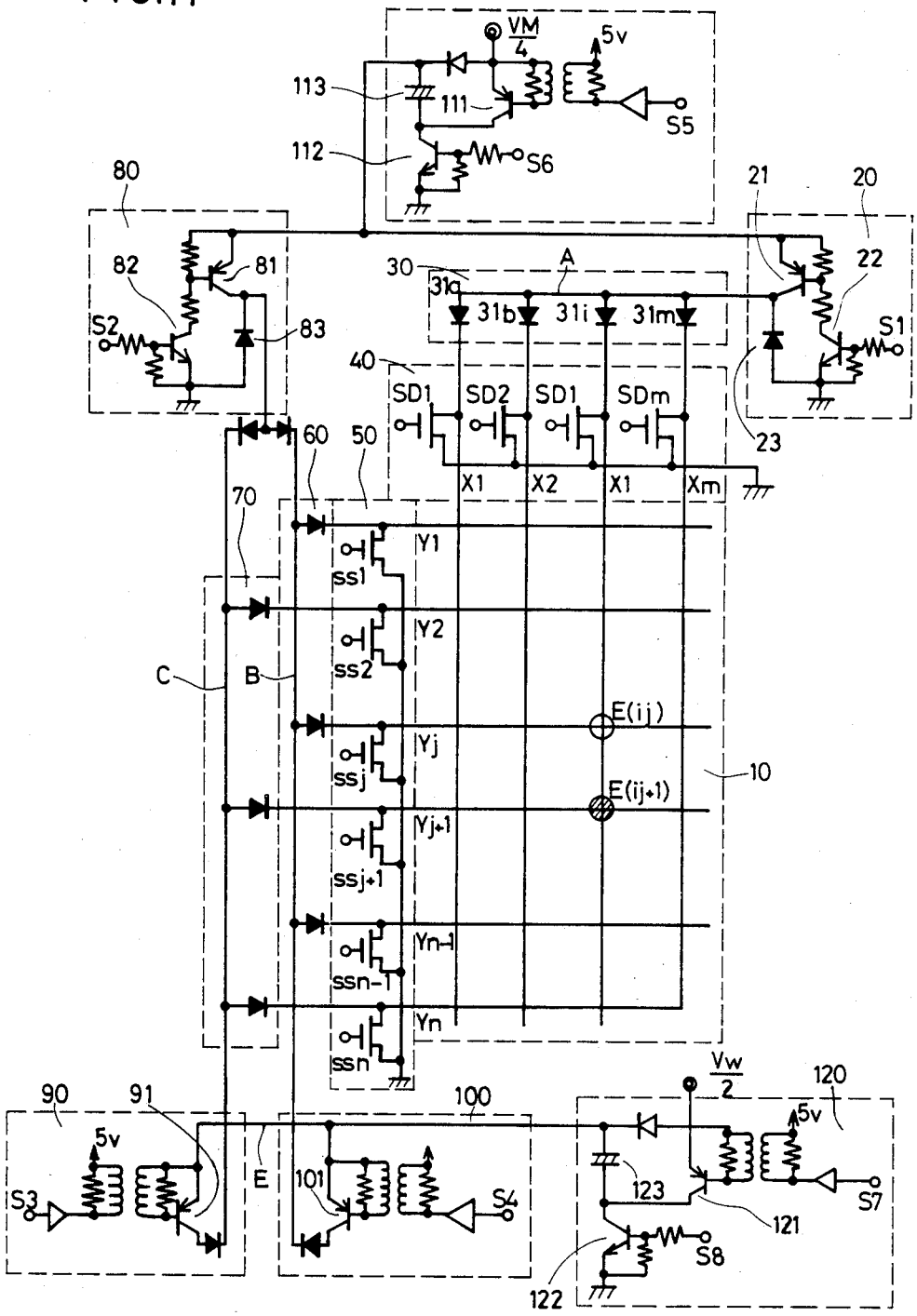
FIG. 11 shows a diagram of a driving circuit according to the present invention.
Figure 12:
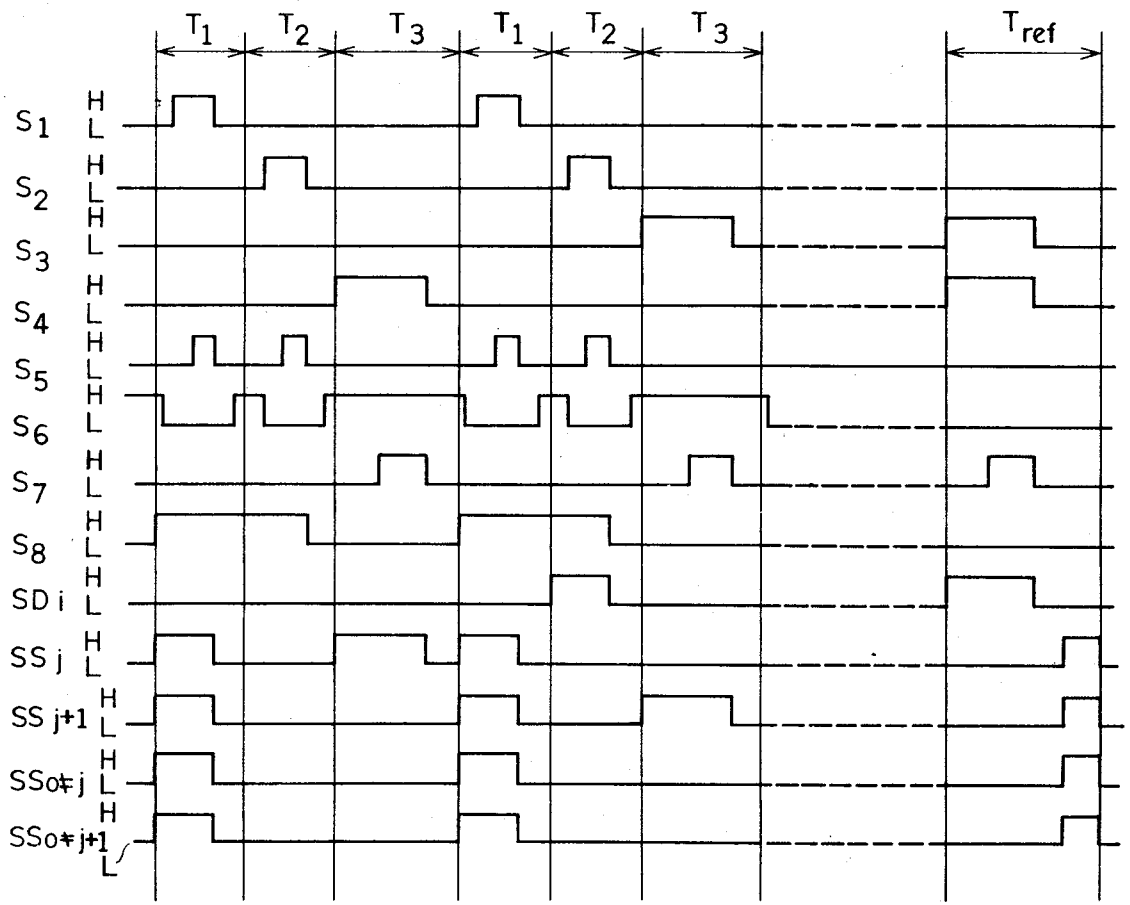
FIGS. 12(A) and 12(B) show timing charts of signals inputted to the circuit of FIG. 11.
Figure 12:
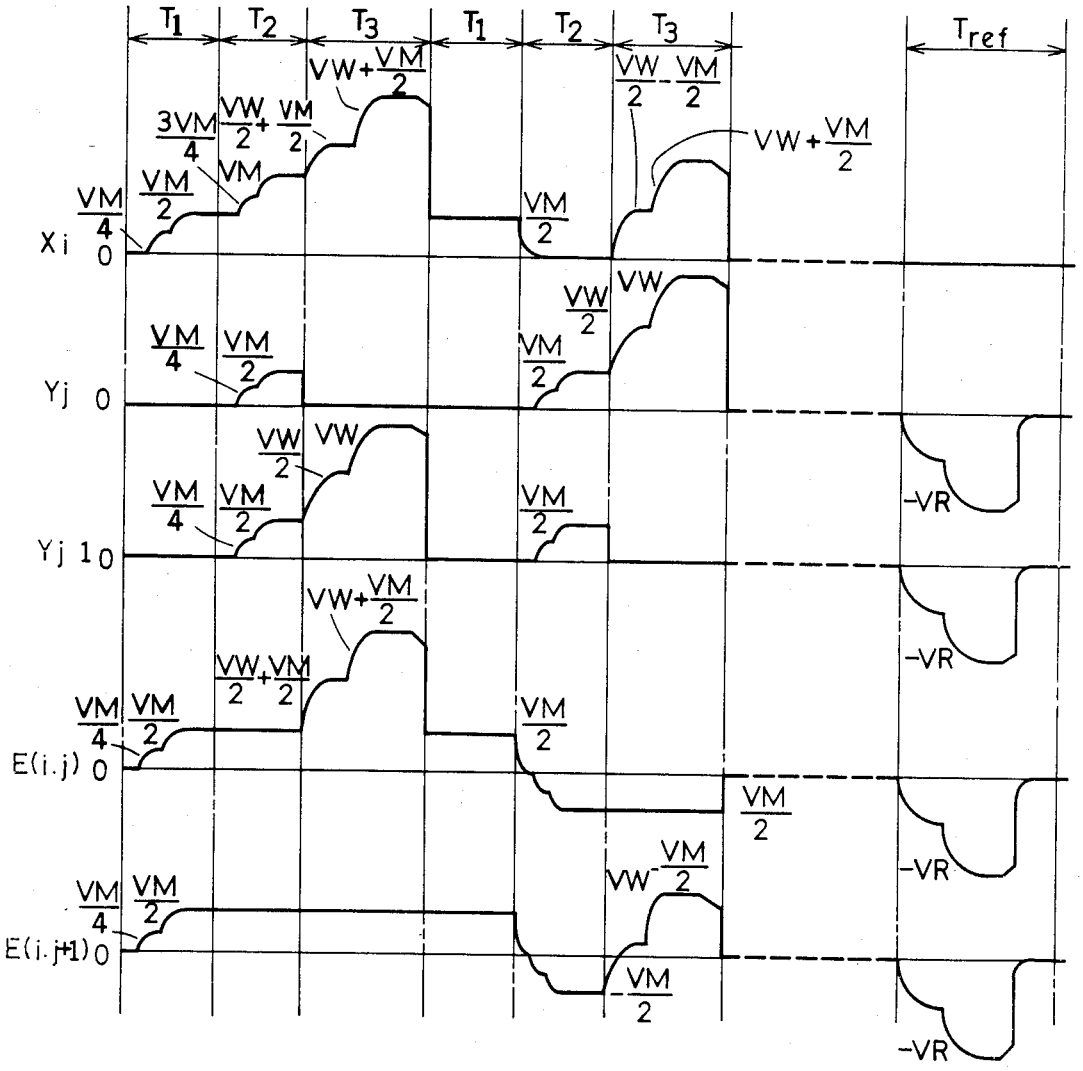

FIG. 11 shows a driving circuit comprising the N-channel MOS IC. FIG. 12 shows a timing chart of signals occurring within the circuit of FIG. 11.

With reference to FIG. 11, a thin-film EL display panel 10 contains data electrodes $X_1$ to $X_m$ in the X direction and scanning electrodes $Y_1$ to $Y_n$ in the Y direction to form a matrix pattern of electrodes. A plurality of thin-film EL picture elements are provided within the panel 10 between the matrix shape electrodes to provide a picture element E (i, j) at each cross point of the electrodes.

Transistors 21 and 22 are operated in response to the application of a signal $S_1$. A charging circuit 20 provides a preliminary charging voltage using the operations of the transistors 21 and 22. The circuit 20 is coupled to the X electrodes through a diode array 30 and a common line A. The diode array 30 contains a plurality of diodes 31*a*, 31*b* . . . 31*m* each corresponding to each of the X electrodes.

The diodes act to protect against reverse bias between data operation lines and N-channel MOS transistors $SD_1$, $SD_2$ . . . $SD_m$. A data-side switching circuit 40 is connected between the diode array 30 and the X electrodes. The circuit 40 comprises N-channel MOS transistors $SD_1$, $SD_2$ . . . $SD_m$, which are coupled between the X electrodes and a grounded line to form a circuit for discharging charges from non-selected picture elements in a writing mode. This circuit functions also as a charging circuit when field refresh pulses are applied.

As to the Y electrodes, a scan-side switching circuit 50 is provided which comprises N-channel MOS transistors $SS_1$, $SS_2$, . . . $SS_n$, which are coupled between the Y electrode and a grounded line to form a circuit for applying writing voltages to selected picture elements in the writing mode. A diode array 60 is provided in which cathodes of diodes are connected to odd numbered lines of the Y electrodes and anodes thereof are connected to common line B. A diode array 70 is provided in which cathodes of the diodes are connected to even numbered lines of the Y electrodes and anodes thereof are connected to a common line C. The diode arrays 60 and 70 are provided for isolating scan-side operation lines and protecting the reverse bias of the switching elements.

A circuit 80 is connected to the common lines B and C. The circuit 80 provides a raised charge voltage with transistors 81 and 82 which are operated in response to the application of a signal $S_2$. A circuit 90 is coupled to the common line C for providing writing pulses and field refresh pulses to the common line C with a transistor 91 is driven conductive in response to the application of a signal $S_3$. A circuit 100 is coupled to the common line B for providing writing pulses and field refresh pulses to the common line B with a transistor 101 which is driven conductive in response to the application of a signal $S_4$.

A circuit 110 functions to provide a preliminary charge voltage and a raised charge voltage in the step driving method. It is connected to the circuits 20 and 80 via a power line D. The circuit 110 raises a voltage on the power line D from $\frac{1}{4}$ $V_M$ to $\frac{1}{2}$ $V_M$ using a condenser coupling with a transistor 111 which is operated in response to the application of a signal $S_5$. With the application of a signal $S_6$, a transistor 112 charges a condenser 113 while transistor 111 is off. A circuit 120 is connected to the circuits 90 and 100. The circuit 120 functions to provide writing pulses and field refresh pulses via a power line E in the step driving method. The circuit 120 raises a voltage on the power lihe E from $\frac{1}{2}$ $V_M(=\frac{1}{2}$ VR) to $V_W(=V_R)$ using the condenser coupling with a transistor 121 which is operated in response to the application of a signal $S_7$. In response to the application of a signal $S_8$, a transistor 122 charges a condenser 123 when a transistor 121 is off.

FIGS. 12(A) and 12(B) show timing charts of the signals occurring within the circuit of FIG. 11. In this preferred form of the present invention, a writing operation voltage $V_W$ is defined to be $V_W=\frac{1}{2}$ $(V_{th}+V_0)$ where $V_{th}$ is an emission starting voltage and $V_0$ is a voltage for emitting a maximum brightness of the electroluminescence.

The value of a field refresh operation voltage $V_R$ is identical to that of the writing operation voltage $V_W$ to reduce the number of the power sources.

The first step $T_1$: a preliminary charge period

High level signals are applied to all of the gates of the scan-side switching elements $SS_1$ to $SS_n$ in the scan-side switching circuit 50 to make them conductive, so that the voltage of the Y electrodes are grounded. In some picture elements in which the voltage of the Y electrodes is higher than that of the X electrodes, charges are discharged via the diode 23, the diode array 30 and the scan-side switching circuit 50. All of the MOS transistors in the data-side switching circuit 40 are off at the same time.

In the circuit 20, the transistors 21 and 22 are on in response to the application of a signal $S_1$ to bear a voltage of $\frac{1}{4}$ VM on the common line A of the diode array 30. When all the picture elements are charged with the voltage of $\frac{1}{4}$ VM, the transistor 111 in the circuit 110 is driven conductive by application of a signal $S_5$. The voltage of $\frac{1}{4}$ VM is superimposed by the condenser 113 to raise the voltage on the power line D up to a voltage of $\frac{1}{2}$ VM. All the picture elements are charged with the voltage of $\frac{1}{2}$ VM. The transistor 112 is made non-conductive. The voltage of VM is related to the emission starting voltage $V_{th}$ and the maximum brightness-supplying voltage $V_0$: $V_M=V_0-V_{th}$.

The second step $T_2$: a period for discharge modification and the rising of a scan-side charge voltage All of the MOS transistors $SS_1$ and $SS_n$ in the scan-side switching circuit 50 are non-conductive. Only some MOS transistors connected to non-selected picture elements in the data-side switching elements array are made conductive. The MOS transistors connected to selected picture elements for emission are made non-conductive.

After the non-selected picture elements are discharged, the transistor 81 in the circuit 80 is driven conductive with the application of the signal $S_2$. The circuit 80 provides a voltage of $\frac{1}{4}$ VM to the switching circuit 50 and the common lines B and C of the diode array 60, so that the scan-side electrodes of all the picture elements have the voltage of $\frac{1}{4}$ VM which is raised. Thus, the circuit 80 serves to provide the raised charge voltage to the scanning sides.

In the circuit 110, the transistor 111 is conductive with the application of a signal $S_5$ to superimpose the voltage of $\frac{1}{4}$ VM with the condenser 113. The voltage on the power line D is raised up to $\frac{1}{2}$ VM. Thus, the circuit 110 serves to raise the voltage of the scan-side electrodes of all the picture elements up to $\frac{1}{2}$ VM.

The third step $T_3$: a writing operation period

It is assumed that the picture element E(i, j) as shown in FIG. 11 is selected to be a picture element to be written. The common line B of the diode array 70 is connected to this selected point. The voltage on the common line B is raised up to $\frac{1}{2}$ VW when the transistor 101 of the circuit 100 is conductive with the application of a signal $S_4$. Only a scan-side MOS transistor SSj of the picture element E(i, j) is conductive and the remaining scan-side MOS transistors are kept non-conductive. While only the MOS transistor SSj is conductive, the transistor 121 in the circuit 120 is conductive with the application of a signal $S_7$. The condenser 123 serves to superimpose a voltage of $\frac{1}{2}$ VW, so that the voltages on the power line E and the common line C are raised up to VW. During this period, all the data-side MOS transistors are kept non-conductive.

This writing operation enables that all the scan-side electrodes except for the selected scanning electrode $Y_j$ to bear the voltage VW through the raise, as defined $VW=\frac{1}{2}(Vth+V_0)$ where $V_{th}$ is the emission starting voltage and $V_0$ is the maximum brightness-supplying voltage.

FIG. 12(B) shows applied wave forms of the picture elements E(i, j) and E(i, j+1) which are exemplified, according to the first to the third steps. The picture element on some selected scanning electrode bears a voltage of $VW+\frac{1}{2}VM$ for emission of the electroluminescence and a voltage of $VW-\frac{1}{2}VM$ for preventing the emission. A modification voltage is VM. The picture element on each non-selected scanning electrode bears a voltage of $\pm\frac{1}{2}VM$. However, emission can not be provided from this point since the voltage of $\frac{1}{2}VM$ is set enough lower than the voltage $V_{th}$.

After the line—at—a—time scanning operation is completed as to all the scanning lines, a field refresh operation is conducted during a period of Tref.

The fourth step: a field refresh operation period Tref

The transistors 91 and 101 in the circuits 90 and 100 serve to provide a voltage of $\frac{1}{2}VR$ ($=\frac{1}{2}VM$) to the common lines B and C with the application of th signals $S_3$ and $S_4$, respectively. All the MOS transistors in the scan-side switching circuit 50 are non-conductive. All the MOS transistors in the data-side switching circuit 40 are conductive. Under the circumstances, the transistor 121 in the circuit 120 is made conductive with the application of the signal $S_7$. The condenser 123 serves to superimpose a voltage of $\frac{1}{2}VR$ ($=\frac{1}{2}VW$) on itself. The voltages on the power line E and the common lines B and C are thereby raised up to VR to thereby apply the voltage of VR to all the picture elements.

According to this field refresh operation, field refresh pulses having a polarity opposed to that in the case of the switching operation are applied to the thin-film EL display panel 10. Then, the application of the AC operation signals for one field (one frame) is completed.

When the field refresh pulses are applied, the field refresh pulses are superimposed with a polarized voltage which is due to the polarization in the picture elements which have already emitted electroluminescence due to the application of the writing voltage. Then, only the picture elements having already emitted the electroluminescence emit the electroluminescence.

In the above described preferred form of the present invention, the voltage VR of the field refresh pulse is the same as the voltage $V_W$ of the writing voltage. The voltage $V_{pre}$ of the preliminary charging is the same as the voltage $V_{BS}$ of the raising charging. This is for simplifying the configuration of the driving circuit. It is evident that the values of these voltages can be freely selected within the knowledge of the present invention.

Figure 13:
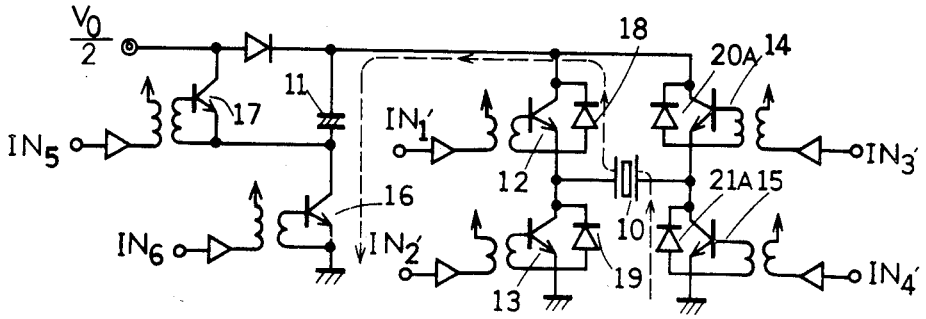
FIG. 13 shows a diagram of a driving circuit according to the present invention.
Figure 14:
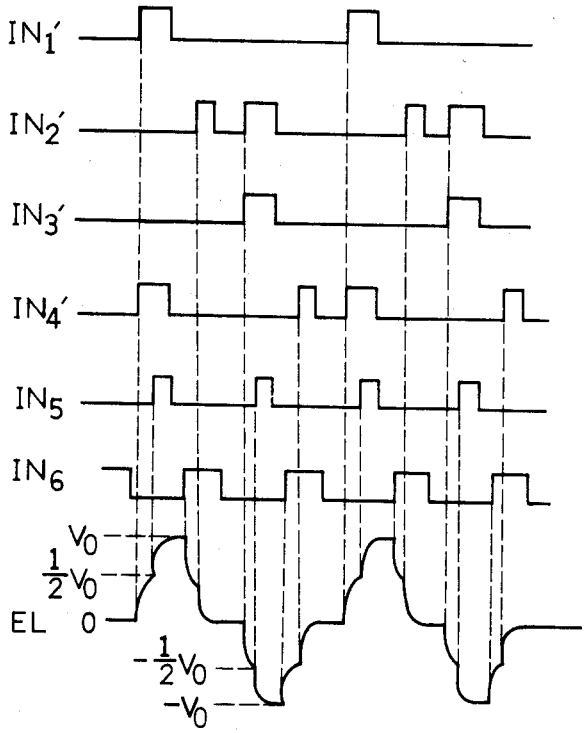
FIG. 14 shows a timing chart of signals inputted to the circuit of FIG. 13.

FIG. 13 shows a driving circuit according to a further preferred embodiment of the present invention. FIG. 14 shows a timing chart of signals occurring within the circuit of FIG. 13. As is similar to the case of FIG. 4, pulses are inputted into terminals $IN_1'$, $IN_2'$, $IN_3'$ and $IN_4'$. The step driving method is enabled by applying signals to a terminal $IN_5$. The raising of signals applied to the thin-film EL display element 10 is caused in two steps and synchronized with the raising of the pulse inputted to the terminal $IN_5$. During a charging period, transistors 12, 15, 14 and 13 are made conductive, in turn, with the application of input signals to the terminals $IN_1'$, $IN_2'$, $IN_3'$ and $IN_4'$ to supply the element 10 a voltage of $\frac{1}{2}V_0$.

A transistor 17 is conductive with the application of a signal to the terminal $IN_5$. A condenser 11 is provided for raising a voltage up $\frac{1}{2}V_0$ to $V_0$ to apply the voltage to the element 10. The condenser 11 has been preliminarily charged via a transistor 16 by a power source having a voltage $\frac{1}{2}V_0$. When each of the capacitances of the panel 10 and the condenser 11 is $C_{EL}$ and C, $C>>C_{EL}$ should be satisfied.

During a discharging period, the transistor 16 is conductive with the application of the signal $IN_6$. A discharging circuit is provided comprising a diode 21A, or 19, the element 10, the diode 18 or 20A, the condenser 11 and the transistor 16. A discharging current flows until the voltage of the condenser 11 is the same as that of the element 10. Hence, charges are supplied from the element 10 back to the condenser 11. The charges stored in the condenser 11 are employed for applying a voltage of $V_0$ having a reverse polarity.

The transistor 13 or 15 is conductive with the application of the signal to the terminal $IN_2'$ or $IN_4'$. The element 10 is discharged until the voltage thereof becomes zero, to thereby complete a course of the application of one pulse. Thus, part of an electric power consumed for discharging can be stored to reduce the power consumed.

While only certain embodiments of the present invention have been described, it will be apparent to those skilled in the art that various changes and modifications may be made therein without departing from the spirit and scope of the invention as claimed.

What is claimed is:

1. A system for driving an electro-luminescent (EL) element with a stepwise driving waveform for reduced power consumption comprising:

first charge circuit means for alternately applying a net charge voltage of one of two polarities across said element to charge said element, said charge voltage being less than a threshold voltage necessary to illuminate said element;

write circuit means for applying a write voltage to develop a net voltage across said element by adding to and subtracting from respective ones of said two polarities of charge voltages, the net voltage developed by adding said write voltage to said charge voltage being sufficient to exceed said threshold voltage, said net voltage when developed by subtracting said charge voltage from said write voltage being insufficient to exceed said threshold voltage;

two step write voltage supply means for supplying said write voltage to said write circuit means in two steps, a first step supplying a substantial portion of said write voltage to said write circuit means for supply to said element while the remaining portion of said write voltage is supplied subsequently thereto in a second step.

2. The system of claim 1 further comprising reset means for applying a reset pulse voltage across said element, said reset means receiving power from said two step write voltage supply means to thereby develop said reset pulse in two steps by supplying a substantial portion of said reset voltage to said reset means for supply to said element and then subsequently applying the remaining portion of said reset voltage to said reset means for supply to said element.

3. The system of claim 1 wherein said two-step write voltage supply means comprises:

means for supplying a supply voltage equal to one half of said write voltage;

means for connecting said means for supplying to said write circuit means during the period of said first and second steps; and voltage doubling means, operatively interconnected between said means for supplying and said write circuit means, for selectively doubling said supply voltage only during the second step subsequent to the period of said first step.

4. The system of claim 3 wherein said voltage doubling means comprises:

a diode having its anode connected to said supply voltage and its cathode connected to said means for connecting, a capacitor having a first terminal connected to the cathode of said diode and a second terminal selectively connected to ground so as to charge said capacitor to said supply voltage; and means for selectively connecting the second terminal of said capacitor to said supply voltage during said second step so as to add the voltage of said charged capacitor to said supply voltage.

5. The system of claim 2 wherein said two-step write voltage supply means comprises:

means for supplying a supply voltage equal to one-half said reset voltage;

means for connecting said means for supplying to said reset means during the period of said reset voltage; and voltage doubling means, operatively interconnected between said means for supplying and said reset means, for selectively doubling said supply voltage only during said remaining portion of said reset voltage.

6. The system of claim 5 wherein said voltage doubling means comprises:

a diode having its anode connected to said supply voltage and its cathode connected to said means for connecting;

a capacitor having a first terminal connected to the cathode of said diode and a second terminal selectively connected to ground so as to charge said capacitor to said supply voltage; and means for selectively connecting the second terminal of said capacitor to said supply voltage during said remaining portion of said reset voltage so as to add the voltage of said charged capacitor to said supply voltage.

7. A system for driving an electro-luminescent (EL) element with a stepwise driving waveform for reduced power consumption, said element having first and second electrodes, comprising:

first charge circuit means for selectively applying a first charge voltage to a first of said electrodes, said first charge voltage being less than a threshold voltage necessary to illuminate said element;

second charge circuit means for selectively applying a second charge voltage to said first electrode and for applying said second charge voltage to said second electrode, said second charge voltage being less than said threshold voltage;

said first and second charge voltages adding across said element to develop a net charge voltage which alternates in first and second polarities across said element;

write circuit means for applying a write voltage to said element to develop a net voltage across said element by adding to said net charge voltage, the net voltage developed by adding said write voltage to said net charge voltage of a first same polarity being sufficient to exceed said threshold voltage, said net voltage when developed by adding said net charge voltage having the opposite second polarity from said write voltage being insufficient to exceed said threshold voltage;

two step voltage supply means for supplying the respective voltage developed by any one of said first and second charge circuit means and said write circuit means in two steps, a first step supplying a substantial portion of said respective voltage while the remaining portion of said voltage is supplied subsequently thereto in a second step to thereby reduce the power consumed by said system.

8. The system of claim 7 further comprising reset means for applying a reset pulse voltage across said element, said two step voltage supply means also supplying power to said reset means.

9. The system of claim 7 wherein said two-step voltage supply means comprises:

means for supplying a supply voltage equal to one-half of said respective voltage;

means for connecting said means for supplying to said first and second charge circuit means and said write circuit means during the period of said first and second stops; and voltage doubling means, operatively interconnected between said means for supplying and said first and second charge circuit means and said write circuit means, for selectively doubling said supply voltage only during the second step subsequent to the period of said first step.

10. The system of claim 9 wherein said voltage doubling means comprises:

a diode having its anode connected to said supply voltage and its cathode connected to said means for connecting;

a capacitor having a first terminal connected to the cathode of said diode and a second terminal selectively connected to ground so as to charge said capacitor to said supply voltage; and means for selectively connecting the second terminal of said capacitor to said supply voltage during said second step so as to add the voltage of said charged capacitor to said supply voltage.

11. A method of driving an electro-luminescent (EL) element with a stepwise driving waveform for reduced power consumption comprising:

applying a net charge voltage across said element to charge said element, said charge voltage being less than a threshold voltage necessary to illuminate said element;

subsequently applying a write voltage to develop a net voltage across said element by adding to and subtracting from respective ones of said two polarities of charge voltage, the net voltage developed by adding said write voltage to said charge voltage being sufficient to exceed said threshold voltage, said net voltage when developed by subtracting said charge voltage from said write voltage being insufficient to exceed said threshold voltage;

each of said steps of applying a write voltage and net charge voltage across said element applying said respective voltage to said element in two steps, a first step applying a substantial portion of each said respective voltage to said element while the remaining portion of said respective voltage being supplied subsequently thereto in a second step.

12. The method of claim 11 further comprising applying a reset pulse voltage across said element in two steps.

13. The method of claim 11 wherein said each of said steps of applying a respective voltage comprise:

applying a supply voltage equal to one-half of said write voltage during the period of said first and second steps; and selectively doubling said supply voltage only during the second step subsequent to the period of said first step.

14. A method of driving an electro-luminescent (EL) element with a stepwise driving waveform for reduced power consumption, said element having first and second electrodes, comprising:

selectively applying a first charge voltage to a first of said electrodes, said first charge voltage being less than a threshold voltage necessary to illuminate said element;

subsequently selectively applying a second charge voltage to said first electrode while applying said second charge voltage to said second electrode, said second charge voltage being less than said threshold voltage, said first and second charge voltages adding across said element to develop a net charge voltage which alternates in first and second polarities across said element;

subsequently applying a write voltage to develop a net voltage across said element by adding to said net charge voltage, the net voltage developed by adding said write voltage to said net charge voltage of a first same polarity being sufficient to exceed said threshold voltage; said net voltage, when developed by adding said net charge voltage having the second opposite polarity from said write voltage, being insufficient to exceed said threshold voltage;

supplying the respective voltage developed by each of said steps of applying a first charge voltage, applying a second charge voltage and applying a write voltage, to said element in two steps, a first step applying a substantial portion of each said respective voltage to said element while the remaining portion of said respective voltage being supplied subsequently thereto in a second step to thereby reduce the power consumed by driving said element.

15. The method of claim 14 further comprising applying a reset pulse voltage across said element also comprises applying a substantial portion of said reset voltage to said element and then subsequently applying the remaining portion of said reset voltage to said element.

16. The method of claim 14 wherein said step of applying a write voltage comprises:

supplying a supply voltage equal to one half of said write voltage during the period of said first and second steps; and selectively doubling said supply voltage only during the second step subsequent to the period of said first step.

17. The method of claim 12 wherein said each of said steps of applying a respective voltage comprises:

applying a supply voltage equal to one-half of said write voltage during the period of said first and second steps; and selectively doubling said supply voltage only during the second step subsequent to the period of said first step.

* * * * *